US012053091B1

(12) United States Patent
Steinman

(10) Patent No.: US 12,053,091 B1
(45) Date of Patent: Aug. 6, 2024

(54) IN-POOL LOUNGER

(71) Applicant: Global Pool Products, Bad Axe, MI (US)

(72) Inventor: Joshua Donald Steinman, Pigeon, MI (US)

(73) Assignee: Global Pool Products, Bad Axe, MI (US)

( * ) Notice: Subject to any disclaimer, the term of this patent is extended or adjusted under 35 U.S.C. 154(b) by 0 days.

(21) Appl. No.: 18/402,669

(22) Filed: Jan. 2, 2024

Related U.S. Application Data

(60) Provisional application No. 63/524,598, filed on Jun. 30, 2023.

(51) Int. Cl.

| | |
|---|---|
| ***A47C 1/14*** | (2006.01) |
| ***A47C 7/62*** | (2006.01) |
| ***A47C 15/00*** | (2006.01) |
| ***A47K 3/12*** | (2006.01) |
| ***E04H 4/14*** | (2006.01) |

(52) U.S. Cl.
CPC ..... *A47C 15/004* (2013.01); *A47C 1/143* (2013.01); *A47C 7/624* (2018.08); *A47K 3/122* (2013.01); *A47K 3/125* (2013.01); *E04H 4/14* (2013.01); *A47C 15/006* (2013.01)

(58) Field of Classification Search
CPC .... A47C 15/004; A47C 15/006; A47K 3/122; A47K 3/125
USPC ..... 4/496
See application file for complete search history.

(56) References Cited

U.S. PATENT DOCUMENTS

| | | | | |
|---|---|---|---|---|
| 2,985,889 | A * | 5/1961 | Fain | A47K 3/122 4/575.1 |
| 4,564,240 | A * | 1/1986 | Thieme | A47C 15/006 297/DIG. 2 |
| 8,167,672 | B2 | 5/2012 | Starmer | |
| 10,104,975 | B2 * | 10/2018 | Anderson | A47C 7/002 |
| D898,391 | S | 10/2020 | Hagerty | |
| D917,189 | S | 4/2021 | Anderson et al. | |
| D917,190 | S | 4/2021 | Anderson et al. | |
| D919,315 | S * | 5/2021 | Svendsen | D6/361 |
| 2011/0283454 | A1 * | 11/2011 | Springer | A61G 15/005 5/602 |
| 2013/0031712 | A1 * | 2/2013 | Gossett | A47C 3/34 4/496 |
| 2013/0341988 | A1 * | 12/2013 | Walker | A47C 9/00 297/452.65 |
| 2020/0095024 | A1 * | 3/2020 | Anderson | A47C 7/00 |
| 2022/0087434 | A1 * | 3/2022 | Anderson | A47C 7/008 |
| 2023/0138564 | A1 * | 5/2023 | Collins | G05D 16/04 4/496 |
| 2023/0210266 | A1 * | 7/2023 | Anderson | F16B 2/22 297/217.1 |
| 2024/0023719 | A1 * | 1/2024 | Anderson | F16B 2/22 |

* cited by examiner

*Primary Examiner* — Robert Canfield
(74) *Attorney, Agent, or Firm* — Mechanicus PLLC

(57) ABSTRACT

A lounge chair designed to rest on the bottom of a body of shallow water, the chair including solid ballast as well as air and water vents to permit rapid filling and emptying of water into a chamber inside the chair.

20 Claims, 5 Drawing Sheets

IN-POOL LOUNGER

CROSS-REFERENCES TO RELATED APPLICATIONS

This application claims the benefit of the filing date of U.S. Provisional Patent Application Ser. No. 63/524,598 filed Jun. 30, 2023, the entirety of which is incorporated herein by reference.

BACKGROUND

Field

This application relates generally to pool furniture.

Description of Related Art Including Information Disclosed Under 37 CFR 1.97 and 1.98

In-pool loungers are chaise-lounge-style chairs configured to sit on the bottom of a pool in areas of shallow water. These chairs are often made of plastic, which (generally having a lower density than water) requires some form of ballast to keep the chair in place. Many such loungers have a hollow interior that may be filled with water, but these water ballast systems must be overfilled relative to the chair's sitting height in the water to ensure negative net buoyancy. Once, filled, these loungers must be sealed to prevent the water from escaping, rendering the chair extremely heavy and difficult to clean or remove from the pool without going through a lengthy period of draining the lounger's interior.

SUMMARY

A lounge chair for use in areas of shallow water comprises a shell including an occupant support surface contoured to support a reclining human occupant, a base surface shaped to rest on a floor of a pool, and a chamber disposed between the upper surface and the base surface. The lounge chair also comprises a water vent formed in the shell and positioned to allow pool water to flow into and out of the chamber when the chair is lowered into and lifted out of the pool, respectively. An air vent is formed in the shell and positioned to allow air to flow into and out of the chamber as water flows out of and into the chamber, respectively. A ballast is carried by the shell and weighted to provide the chair with negative buoyancy in cooperation with water occupying the chamber.

DRAWING DESCRIPTIONS

These and other features and advantages will become apparent to those skilled in the art in connection with the following detailed description and drawings of one or more embodiments of the invention, in which.

DETAILED DESCRIPTION

Figure 9:
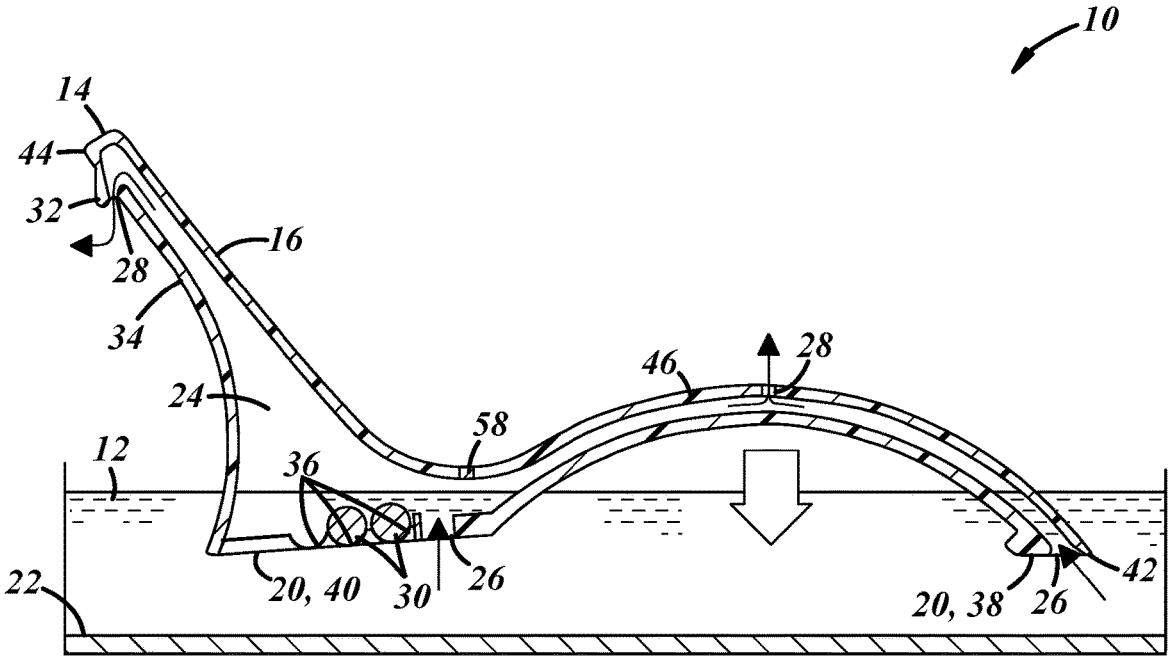
FIG. 9 is a side cutaway view showing air and water flow through the chair of FIG. 1 as it is dropped into a pool.
Figure 10:
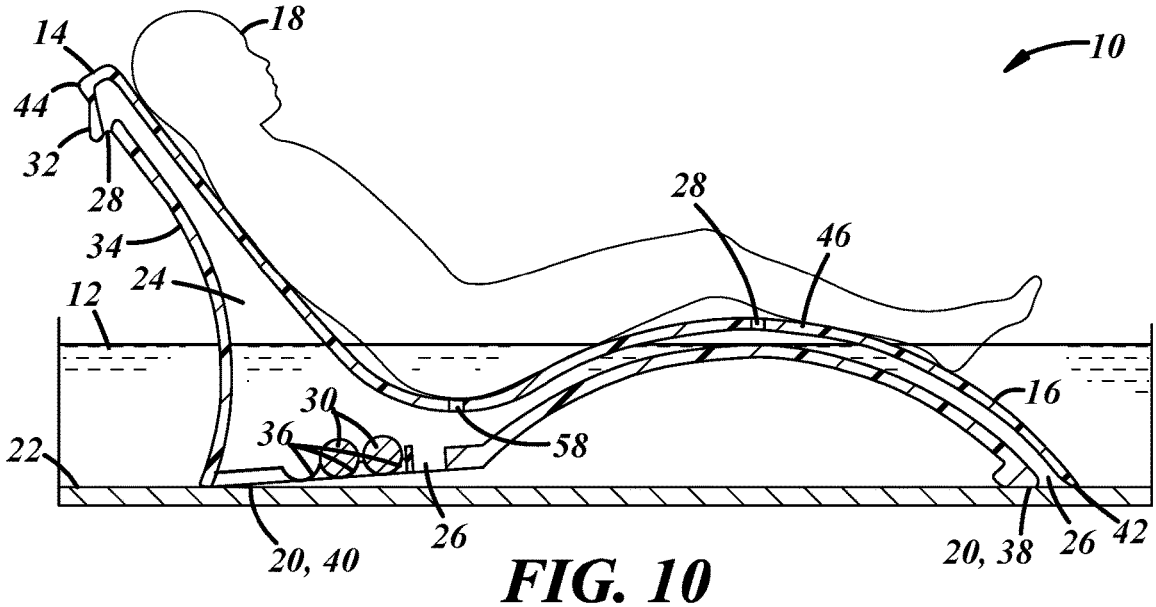
FIG. 10 is a side cutaway view showing the chair of FIG. 9 as it appears when initially touching the bottom of the pool of FIG. 9.
Figure 11:
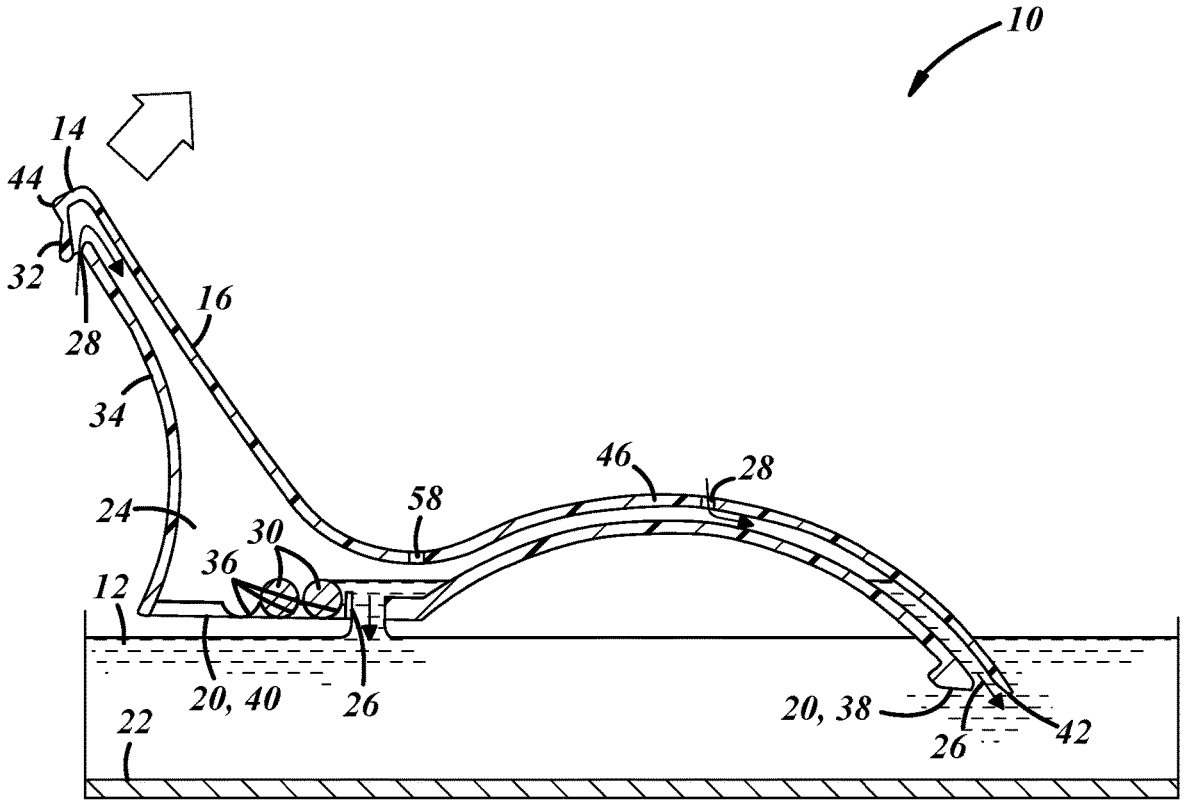
FIG. 11 is a side cutaway view showing air and water flow through the chair of FIG. 10 as it is lifted out of the pool after its immersion in FIG. 10.

A lounge chair (generally indicated at 10 in the Figures) for use in shallow areas of a pool 12 (i.e., a recess/basin/reservoir or similar feature for retaining a body of water) may comprise a shell 14 including an occupant support surface 16 contoured to support a reclining human occupant 18, and a base surface 20 shaped to rest on a floor 22 of a pool 12. As best shown in FIGS. 9-11, a chamber 24 is disposed between the occupant support surface 16 and the base surface 20, and one or more water vents 26 may be formed in the shell 14 and positioned to allow pool water to flow into and out of the chamber 24 when the chair 10 is lowered into and lifted out of the pool 12, respectively. An air vent 28 is formed in the shell 14 and positioned to allow air to flow into and out of the chamber 24 as water flows out of and into the chamber 24, respectively. A ballast 30 is carried by the shell 14 and weighted to provide the chair 10 with negative buoyancy in cooperation with water occupying the chamber 24. The chair 10 is therefore configured to sink and remain on the floor 22 of the pool 12 without floating, if placed in the water of the pool 12.

The shell 14 of the chair 10 may be hollow, and in the preferred embodiment shown in the drawings, the chamber 24 comprises the entirety of an interior volume of the shell 14. This shell 14 may be formed by rotomolding, or by any other suitable technique for forming hollow objects. A grab handle 32 may be molded into a back surface 34 of the shell 14, positioned adjacent where a head of an occupant 18 would rest if the occupant 18 reclines on the occupant support surface 16 in accordance with the occupant support surface's contour. The grab handle 32 may be located where it may be comfortably grabbed to pull the chair 10 out of a pool 12, and the location may be further chosen relative to the chair's center of gravity (when filled and/or unfilled with water) so that lifting the chair 10 via the grab handle 32 allows a person to naturally pull the chair 10 out of the water at an angle allowing water to easily escape from the water vents 26 without being trapped within the chamber 24.

The ballast 30 may comprise a solid substance, such as concrete, for example. However, any captive substance heavier than water may be suitable. The ballast 30 may be located within the chamber 24, and the ballast 30 may be weighted so that the ballast 30 and water in the chamber 24 may cooperate to give the lounge chair 10 negative buoyancy when placed in pool water having a depth where a water line of the pool water would be adjacent the air vent 28 if the base surface 20 rests on the pool floor 22. The ballast 30 may also only need to possess sufficient weight to overcome any inherent buoyancy of the substance that the shell 14 is formed from (at least, the amount of buoyancy it produces when the base is resting at a desired depth on the pool floor 22), to allow the chair 10 to begin taking on water via the water vents 26 when dropped into the water with a dry chamber 24. The chair 10 therefore may not need to primarily rely on water to serve as ballast 30, and the water may merely help to displace any interior air within the chamber 24 that would cause unwanted buoyancy.

Accordingly, the ballast 30, chamber 24, water vent 26, and air vent 28 may be proportioned, relative to one another, to provide negative buoyancy when placed in pool water having a depth where a water line of the pool water is adjacent the air vent 28 if the base surface 20 rests on the pool floor 22. And the chair 10 may achieve this negative buoyancy merely by being dropped in the water. The open water vents 26 permit the chamber 24 to be emptied rapidly, merely by lifting the chair 10 from the water via the grab handle 32. Unlike older in-pool loungers that rely on water as ballast, this lounge chair 10 has no need to be pre-filled or overfilled, and no need to employ a plug to stop air from passing through the air vent 28 or to stop water from passing through the water vent 26. This vent and ballast arrangement allows the chair 10 to sink even when constructed as a hollow shape (as produced via rotomolding), and does not trap stagnant water in the chair's interior (which would risk growth of algae, mold, or other contaminants).

In the exemplary embodiment shown in the figures, the ballast 30 may comprise multiple cylindrical weights 30, and the chamber 24 may include multiple ballast sockets 36 shaped to receive and secure the cylindrical weights 30. Users of the chair 10 may adjust the chair's buoyancy by adding or removing more of the cylindrical weights 30 from the ballast sockets 36. A factory default configuration, for example, may comprise a lounge chair 10 in which only two out of three ballast sockets 36 are occupied.

As shown in the figures, the base surface 20 may comprise both a front base surface 38 and a back base surface 40 located adjacent respective front 42 and back 44 ends of the chair 10. As best shown in FIG. 10, the back base surface 40 may be angled so that it does not naturally rest flat on the pool floor 22 when both the front 38 and back 40 base surfaces are touching the pool floor 22. The ballast sockets 36 (or any other suitable means for securing the ballast 30) may be located such that, when the ballast 30 is installed, the center of gravity of the chair 10 is located between the points where the front 38 and back 40 base surfaces contact the pool floor 22. In this way, the angle of the back base surface 40 and location of the ballast 30 helps to secure the front end 42 of the chair 10 by distributing weight forward to the front base surface 38 through the arched leg-support region 46 of the chair 10. This distributed weight, which would otherwise be mostly supported by the back base surface 40, helps to increase friction and pressure between the front base surface 38 and the pool floor 22.

The material of the chair 10 may also be flexible enough to permit the back base surface 40 to be flattened against the pool floor 22 when a sufficiently heavy load is placed on the chair 10. This flexibility allows the back base surface 40 to support a higher proportion of heavier loads once the back base surface 40 is flattened, relative to the proportion of loads that the back base 40 supports when it is not flattened against the pool floor 22. This reduces relative loading distribution to the front base surface 38 as the weight of a load increases past the point of flattening the rear base surface 40, reducing the risk of damage to the arched leg-support region 46.

The air 28 and water vents 26 may comprise multiple respective air and water vent holes. In a preferred embodiment, some air vents 28 may be located within the grab handle 32, while more air vents 28 are positioned in the shell 14 adjacent where the knees of an occupant 18 would rest if the occupant 18 reclined on the occupant support surface 16 in accordance with the occupant support surface's contour. The water vents 26 may be positioned adjacent the base surface 20 near where the occupant's feet and rear would rest if the occupant 18 reclines on the occupant support surface 16 in accordance with the occupant support surface's contour.

Figure 1:
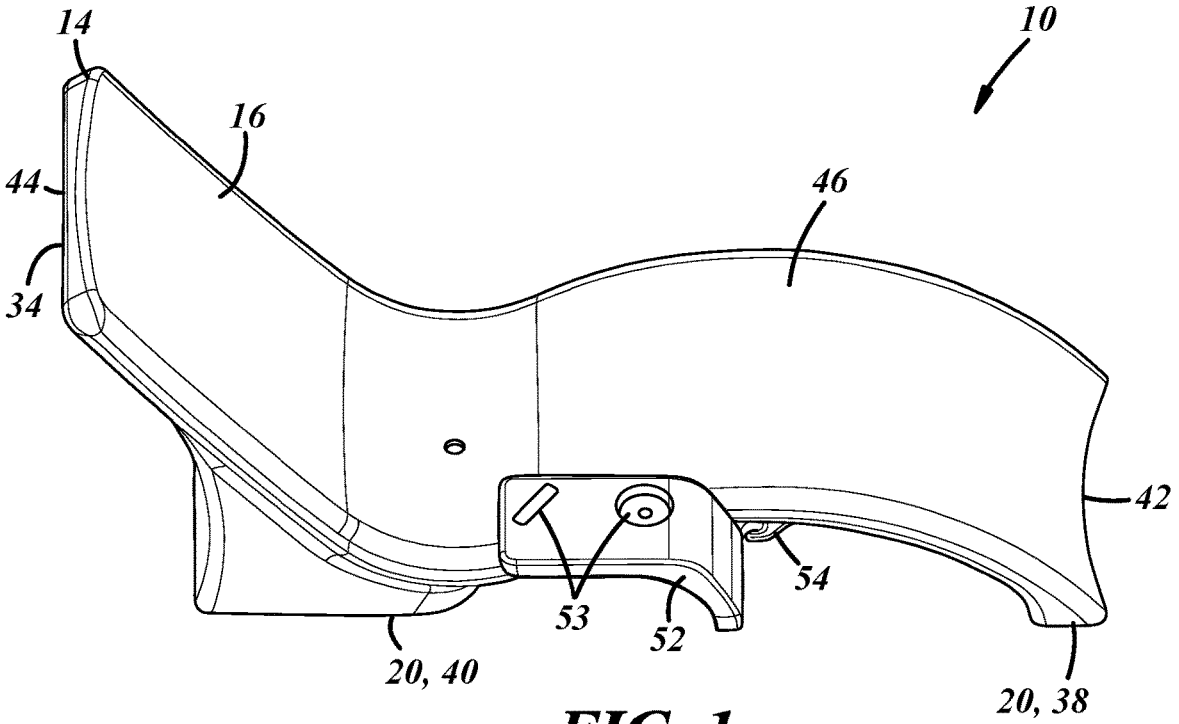
FIG. 1 is a top/side perspective view of a lounge chair for use in shallow areas of a pool.
Figure 2:
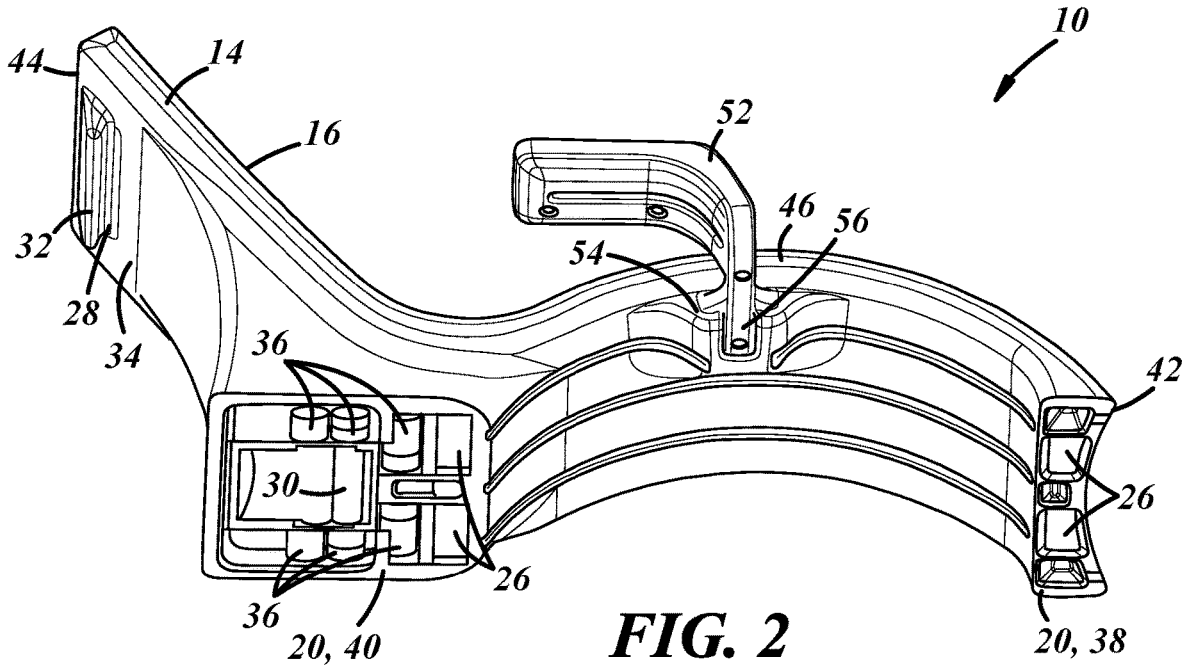
FIG. 2 is a bottom/side perspective view of the chair of FIG. 1.
Figure 3:
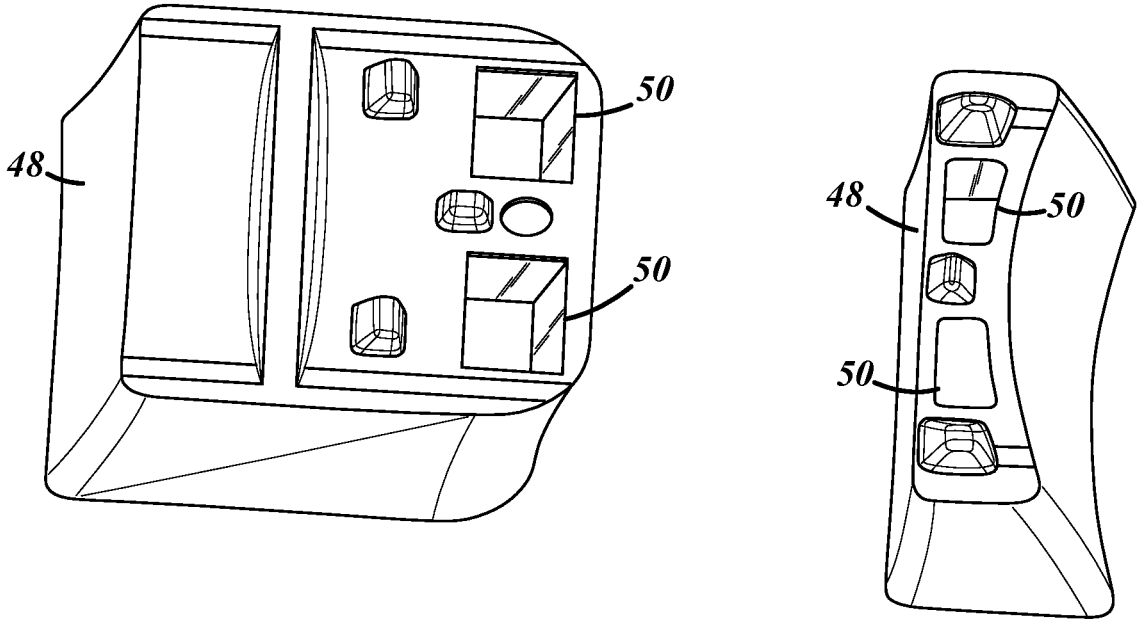
FIG. 3 is a top perspective view of risers shaped to support the chair of FIG. 1.
Figure 4:
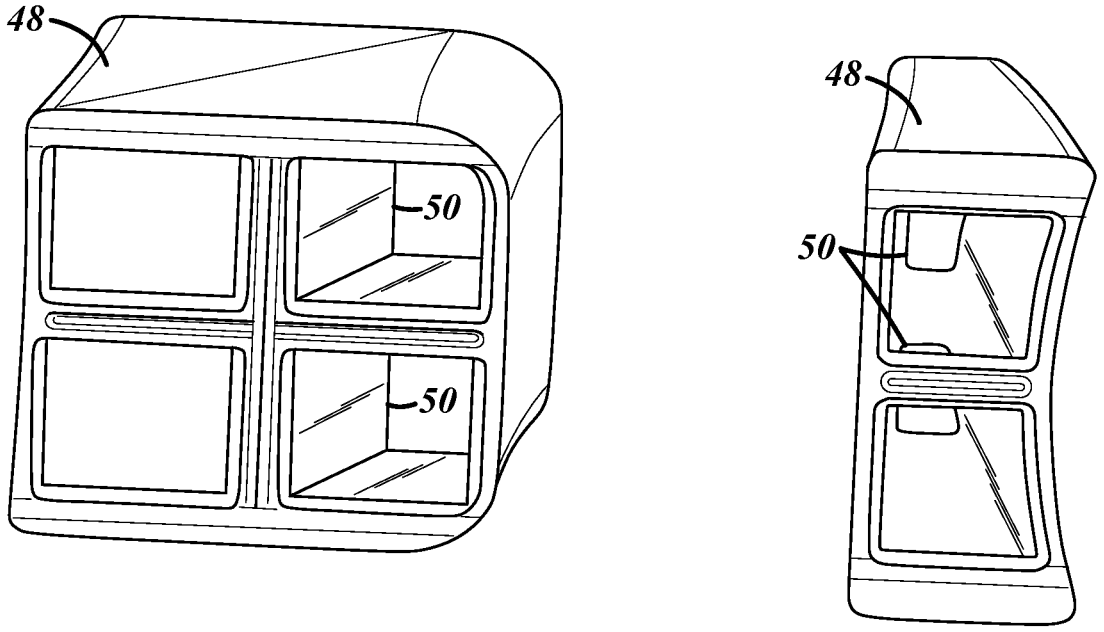
FIG. 4 is a bottom perspective view of the risers of FIG. 3.
Figure 5:
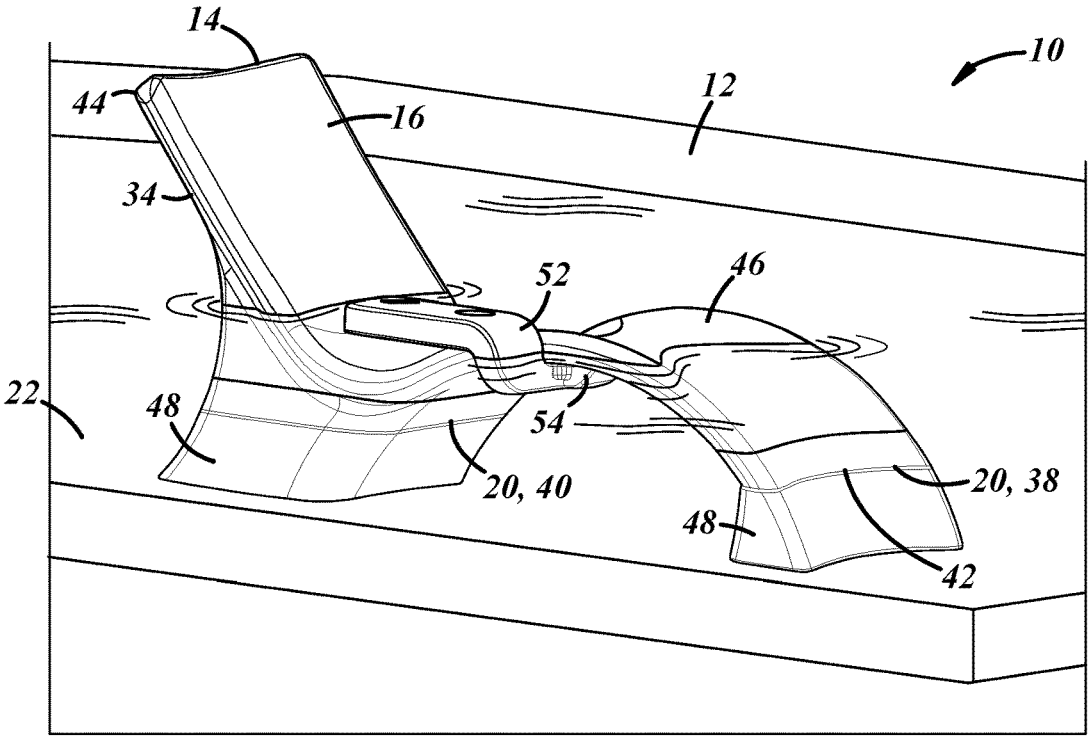
FIG. 5 is a perspective view of the chair of FIG. 1 supported by the risers of FIG. 3.

Risers 48 of various heights may be removably attached to the lounge chair 10 adjacent the base surface 20, as shown in FIG. 5. The risers 48 may be shaped to support the lounge chair 10 on the pool floor 22, and to smoothly extend the general shape of the chair. Selection of taller risers 48 may permit the lounge chair 10 to be placed in deeper water. The risers 48 may also be shaped to permit water to flow through the water vents 26, when the risers are attached, for this purpose, and as shown in FIGS. 3 and 4, the risers may comprise riser vents 50 located within the riser so that they align with the water vents 26, allowing water to flow through the risers 48 as it flows through the rest of the chair 10.

Figure 6:
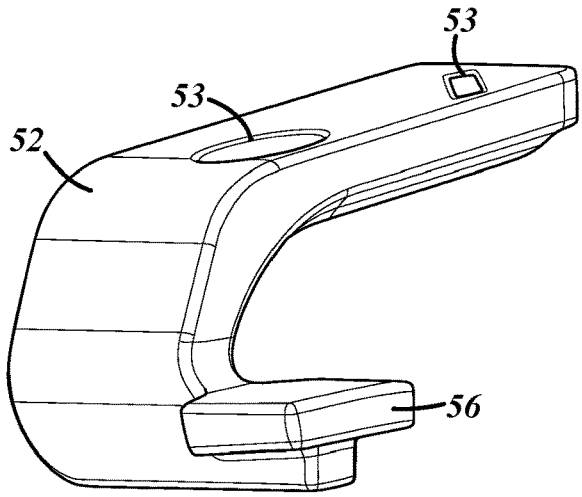
FIG. 6 is a perspective view of an accessory arm of the chair of FIG. 1, shown detached from the chair.
Figure 7:
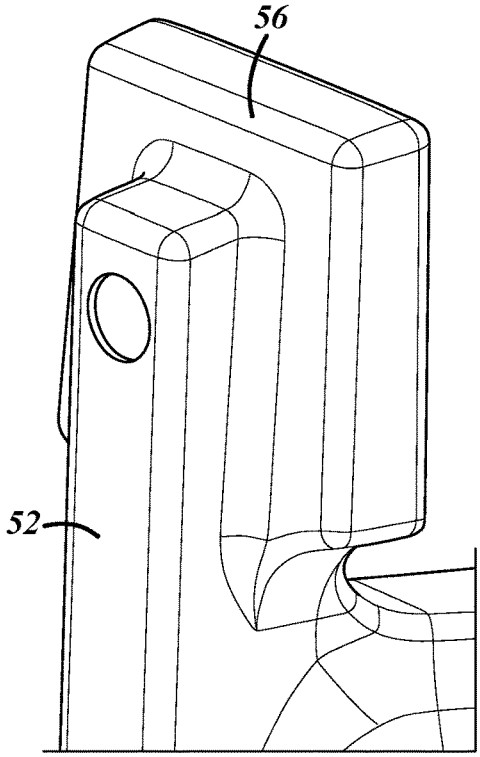
FIG. 7 is a closeup view of an interface end of the accessory arm of FIG. 6.
Figure 8:
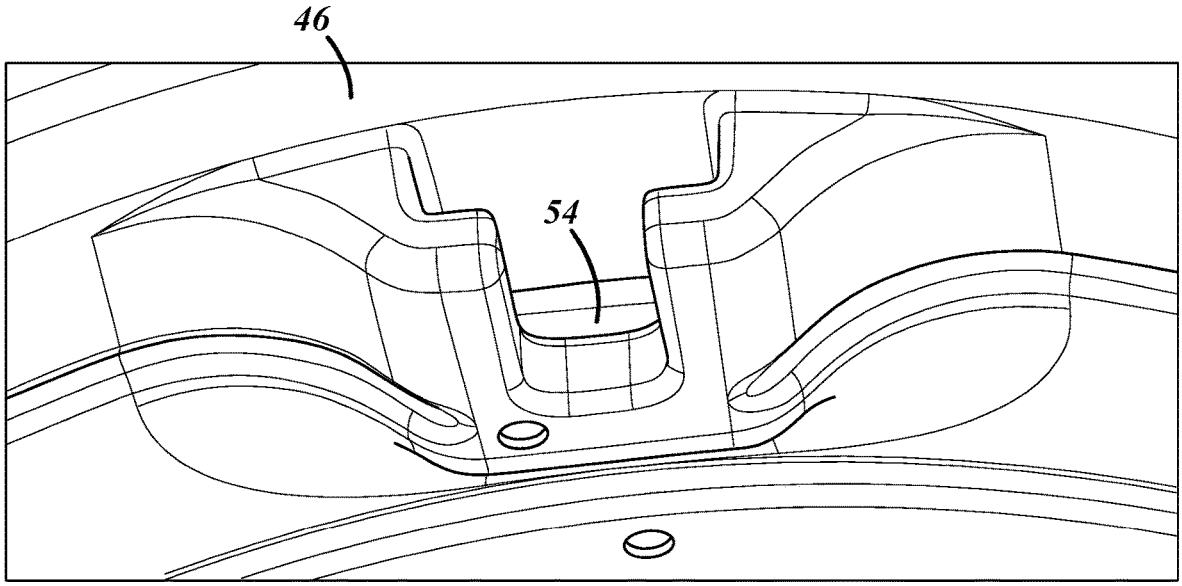
FIG. 8 is a closeup view of an arm attachment interface of the chair of FIG. 1 which is shaped to receive the interface end of FIG. 7.

As best shown if FIGS. 5-7, an accessory arm 52 may be detachably attached to the lounge chair 10 and shaped to extend to one side of the shell 14 to hold personal items within reach of the occupant 18. For this purpose, holders 53 may be molded into the arm 52, as shown in FIG. 6, and shaped to secure items such as drinks or phones. The arm 52 may be connected to the chair 10 at an arm attachment interface 54 located on the shell 14 of the lounge chair 10 and shaped to receive an interface end 56 of the accessory arm 52. At least one of the arm attachment interface 54 or interface end 56 of the accessory arm 52 may be tapered so that the fit tightens between the accessory arm interface end 56 and arm attachment interface 54 in at least two dimensions as they are engaged together. In other words, engaging the accessory arm 52 with the attachment interface 54 wedges the two components together via a tightening interference fit in addition to any mechanical fasteners or flanges that may be used to positively position the arm 52 relative to the lounge chair 10.

The chair 10 may also include a drain 58 located in a concave portion of the occupant support surface 16. The drain 58 may be positioned to permit water to drain from the occupant support surface 16 into the chamber 24. The drain 58 accordingly helps to prevent rainwater from pooling and stagnating on the occupant support surface 16 if the chair 10 is sitting outside the pool 12. The drain 58 may also function like the water 26 or air vents 28 depending on the water level within the chamber 24.

A lounge chair 10 constructed as described above can be easily installed in many shallow bodies of water simply by dropping it in place and allowing it to fill with water to sink to rest on a bottom of the body of water. The lounge chair 10 may also be extracted easily from the water (for storage, or for use as a lounger on dry land), rapidly emptying itself as it is pulled from the water to minimize effort or risk of injury on the part of the user.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A lounge chair for use in areas of shallow water; the lounge chair comprising:

a shell including a back rest portion extending upwardly and backward from a seat portion that joins the back rest to an arched leg rest portion extending upwardly and forward from the seat portion in a direction opposite the back rest portion, an occupant support surface comprising upper surfaces of the back rest, seat, and leg rest portions and contoured to support a reclining human occupant, a base surface shaped to rest on a floor of a pool, and a chamber disposed between the occupant support surface and the base surface;

a water vent formed in the shell and positioned to allow pool water to flow into and out of the chamber when the chair is lowered into and lifted out of the pool, respectively;

an air vent formed in the shell and positioned to allow air to flow into and out of the chamber as water flows out of and into the chamber, respectively; and a ballast carried by the shell and weighted to provide the chair with negative buoyancy in cooperation with water occupying the chamber.

2. The lounge chair of claim 1 in which:

the shell is hollow;

the chamber comprises the entirety of an interior volume of the shell; and the ballast is located within the chamber.

3. The lounge chair of claim 1 in which the ballast comprises a solid substance.

4. The lounge chair of claim 1 in which the ballast comprises concrete.

5. The lounge chair of claim 1 in which the chair is shaped such that ballast and water in the chamber cooperate to give the lounge chair negative buoyancy when the chair has been placed in pool water having a depth where a water line of the pool water is below the air vent with the base surface resting on the pool floor.

6. The lounge chair of claim 1 in which the air vent comprises multiple air vent holes.

7. The lounge chair of claim 1 in which the water vent comprises multiple water vent holes.

8. The lounge chair of claim 1 including a grab handle positioned on the back rest portion of the shell.

9. The lounge chair of claim 8 in which the grab handle is molded into a back surface of the back rest portion of the shell.

10. The lounge chair of claim 8 in which the air vent is positioned within the grab handle.

11. The lounge chair of claim 1 in which the air vent is formed through the shell and is located in the arched leg rest portion of the shell.

12. The lounge chair of claim 1 in which the water vent is positioned and oriented in the base surface in a location and direction that allows pool water to exit the chamber and exit downward from the shell when the chair is lifted from the pool.

13. The lounge chair of claim 1 in which the water vent comprises multiple water vents, at least one water vent being positioned on the base surface where it will allow water to exit the chamber from under the seat portion of the shell and at least one other water vent being positioned on the base surface where it will allow water to exit the chamber from under the leg rest portion of the shell.

14. The lounge chair of claim 1 in which the ballast, chamber, water vent, and air vent are positioned and proportioned to provide negative buoyancy when the chair is placed in pool water to a depth where a water line of the pool water is below the air vent with the base surface resting on the pool floor, and without the air vent being plugged to stop air from passing through.

15. The lounge chair of claim 1 in which the ballast, chamber, water vent, and air vent are positioned and proportioned to provide negative buoyancy when the chair is placed in pool water to a depth where a water line of the pool water is above the air vent with the base surface resting on the pool floor, and without the air vent being plugged to stop water from passing through.

16. The lounge chair of claim 1 including risers attachable to the base surface, the risers:

being shaped to support the lounge chair on, and space the lounge chair from, the pool floor; and comprising riser vents shaped to align with, and permit water to flow through, the water vent when the risers are installed on the lounge chair.

17. The lounge chair of claim 1 comprising an accessory arm detachably attached to the lounge chair and shaped to extend to one side of the shell to hold personal items within reach of the occupant.

18. The lounge chair of claim 16 including an arm attachment interface located on the shell of the lounge chair and shaped to receive an interface end of the accessory arm, at least one of the arm attachment interface or interface end of the accessory arm being tapered to provide an interference fit that tightens between the accessory arm interface end and arm attachment interface in at least two dimensions as they are engaged together.

19. A lounge chair for use in areas of shallow water; the lounge chair comprising:

a shell including a back rest portion extending upwardly and backward from a seat portion that joins the back rest to an arched leg rest portion extending upwardly and forward from the seat portion in a direction opposite the back rest portion, an occupant support surface comprising upper surfaces of the back rest, seat, and leg rest portions and contoured to support a reclining human occupant, a base surface comprising:

a back base surface shaped and positioned to rest on a pool floor beneath the seat portion, and a front base surface shaped and positioned to rest on the pool floor beneath the leg rest portion in a location spaced from the back base surface, and the back base surface is shaped and positioned so that it does not lie flat on the pool floor when the front and back base surfaces both touch the pool floor without force, to compress the lounge chair against the pool floor;

a chamber disposed between the occupant support surface and the base surface;

a water vent formed in the shell and positioned to allow pool water to flow into and out of the chamber when the chair is lowered into and lifted out of the pool, respectively;

an air vent formed in the shell and positioned to allow air to flow into and out of the chamber as water flows out of and into the chamber, respectively; and a ballast carried by the shell and weighted to provide the chair with negative buoyancy in cooperation with water occupying the chamber.

20. The lounge chair of claim 19 in which the back base surface is shaped and positioned so that only a rear portion of the back surface touches the pool floor when the front and back base surfaces both touch the pool floor without force to compress the lounge chair against the pool floor.

* * * * *